United States Patent [19]

Roberts et al.

[11] B 3,995,349

[45] Dec. 7, 1976

[54] DOOR HANDLE OF A HOUSEHOLD REFRIGERATOR

[75] Inventors: Edward H. Roberts, Jeffersontown; Gordon V. Carter, Louisville, both of Ky.

[73] Assignee: General Electric Company, Louisville, Ky.

[22] Filed: June 24, 1975

[21] Appl. No.: 589,687

[44] Published under the second Trial Voluntary Protest Program on March 23, 1976 as document No. B 589,687.

[52] U.S. Cl. ..... 16/125

[51] Int. Cl.[2] ..... A47B 95/02

[58] Field of Search ..... 16/110 R, 111 R, 125; 312/320; 49/460

[56] References Cited

UNITED STATES PATENTS

| | | | |
|---|---|---|---|
| 2,186,683 | 1/1940 | Raymond | 16/125 |
| 2,608,712 | 9/1952 | Seyforth | 16/125 |
| 3,766,598 | 10/1973 | Roberts | 16/125 |

*Primary Examiner*—Andrew V. Kundrat

[57] ABSTRACT

A door handle of a household refrigerator has a base assembly formed of three elements. The first and second elements hook together and the third element nests in the first element and extends over the hook portion of the third element. A cover extends over the base assembly and is nestable in the second and third elements. The cover has locking tabs matable with edges of the second element for connecting the cover to the second element and maintaining the elements together to form a unitary handle that is attachable to a refrigerator door.

10 Claims, 6 Drawing Figures

DOOR HANDLE OF A HOUSEHOLD REFRIGERATOR

BACKGROUND OF THE INVENTION

Handles are generally formed of two or more parts as, for example, the handle shown in U.S. Pat. No. 2,608,712-Seyforth. In general, the separate parts are a base member that is connectable to a door or drawer and a decorative cover element that is attached to the base member for enhancing the appearance of the handle.

In order to manufacture refrigerators of different forms while maintaining a pleasing overall appearance, it is necessary to provide the refrigerator with a handle which is of a configuration that complements the artistic lines of that particular refrigerator. It is also desirable that the handles for the various refrigerators be formed of interchangeable parts, adapted for easy conversion to handles of different configurations, and constructed for easy and quick assembly.

The household refrigerator door handle of this invention is constructed to provide for either front or back mounting. The handle is also adapted for easy conversion to a plurality of different configurations and the interchangeable parts of various handles that can be constructed are assembled without the use of screws or bolts.

SUMMARY OF THE INVENTION

In accordance with this invention, a door handle of a household refrigerator has a first element of channel configuration. The first element has a first opening and a boss positioned adjacent the first opening. The boss has an opening extending therethrough for receiving a mounting screw and an edge that overlies the first opening. A second element is of channel configuration. The second element has inwardly extending edge portions and a protrusion of dimensions sufficient for insertion into the first opening for connecting the first and second elements together. A third element is nestable in the first element and extends over the second element protrusion. The third element has a nut alignable with the boss opening for receiving a mounting screw and connecting the elements to a refrigerator. A cover extends over the elements and has locking tabs that are matable with the second element edge portion for connecting the cover to the second element.

DETAILED DESCRIPTION OF THE INVENTION

Figure 1:
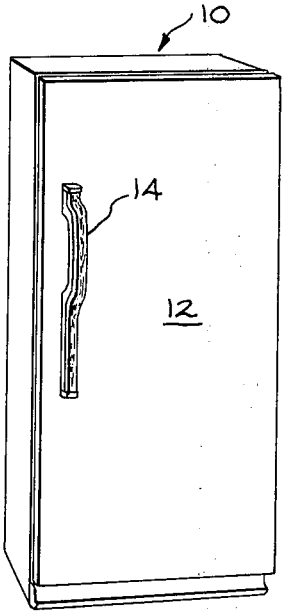
FIG. 1 is a perspective view of a household refrigerator having the door handle of this invention.

In the embodiment of FIG. 1, a household refrigerator 10 has a door 12 with the door handle 14 of this invention attached to the door 12.

Figure 3:
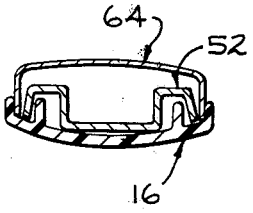
FIG. 3 is a diagrammatic sectional view taken along line III—III of the door handle of FIG. 2.
Figure 2:
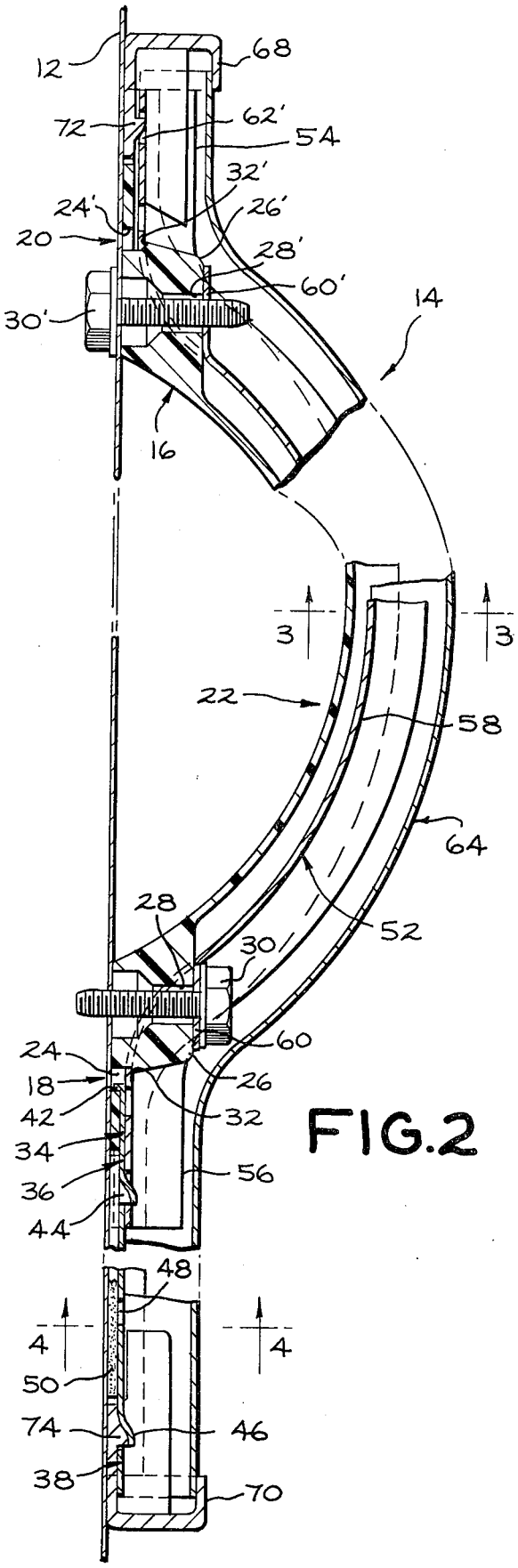
FIG. 2 is a diagrammatic side view in partial section of the door handle of FIG. 1.
Figure 5:
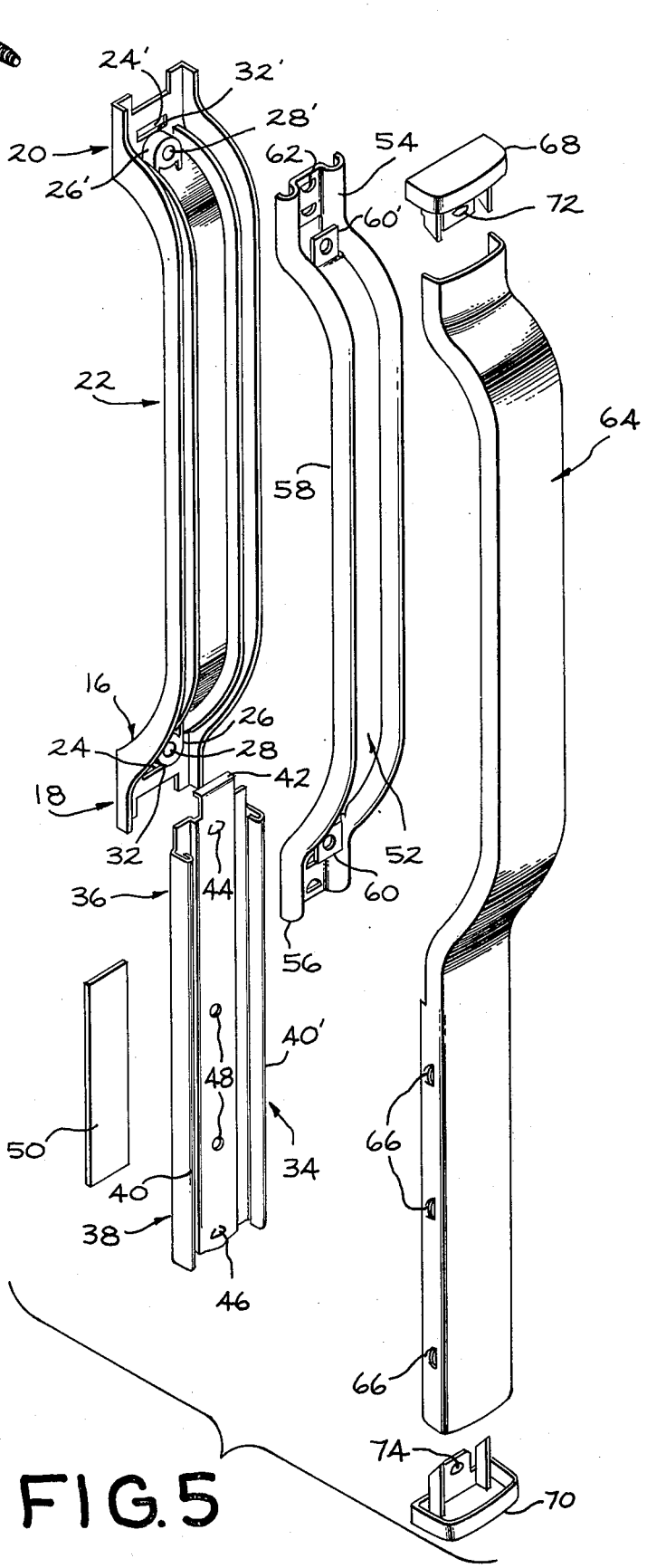
FIG. 5 is a diagrammatic exploded view of the handle of FIG. 2.

Referring to FIGS. 2, 3, and 5, the door handle 14 has a primary base element 16 of channel configuration, as better seen in FIG. 3. The primary base 16 has first and second end portions 18, 20 and a middle portion 22. At least one of the end portions 18 or 20, preferably both end portions 18, 20, have a first opening 24, 24' extending therethrough and a screw boss 26, 26' positioned adjacent the respective first opening 24, 24'. The screw bosses 26, 26' each have an opening 28, 28' extending therethrough for receiving a threaded member 30, 30', as hereafter more fully described. Each of the screw bosses 26, 26' has an edge 32, 32' overlying the respective first opening 24, 24'.

Figure 4:
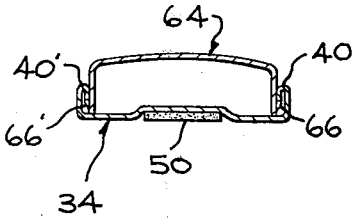
FIG. 4 is a diagrammatic sectional view taken along line IV—IV of the door handle of FIG. 2.

A secondary base element 34 has first and second end portions 36, 38 and is of channel configuration having inwardly and downwardly extending edge portions 40, 40', as better seen in FIG. 4. The secondary base element 34 has a downwardly extending protrusion 42 positioned at the first end portion 36 of said element 34. The protrusion 42 is of dimensions sufficient for insertion into one of the first openings 24 or 24' of the primary base 16 under the overlying boss edge 32 or 32'. Corner edges of the secondary base element 34 are positioned under edge portions of the primary base with the protrusion 42 inserted in the first opening 24 or 24' for locking the base elements 16, 34 together.

The secondary base element 34 can also have a locking tab 44 positioned on the first end portion 36 adjacent the protrusion 42 and a locking tab 46 positioned on the second end portion 38. The locking tabs 44, 46 can be of either concave or convex configuration for cooperating with tabs of associated elements, as hereinafter more fully described. The secondary base element 34 can also have openings 48, 48' extending therethrough to receive screws (not shown) and can have tape 50 attached thereto for connecting the secondary base element 34 to the refrigerator door 12.

A tertiary base element 52 is of channel configuration and has first and second end portions 54, 56, and a middle portion 58. The tertiary base element 52 is of dimensions sufficient for nesting in the primary base element 16, as better seen in FIG. 3, and extending over the first end portion 36 of the secondary base element 34. Nuts 60, 60' of the tertiary base element 52 are positioned coaxially with the openings 28, 28' of respective bosses 26, 26' of the primary base element 16.

The nuts 60, 60' can be flanges of the tertiary base element 52 each having an opening matable with threads of the associated threaded member 30, 30' or can be separate, threaded nuts each fixedly connected to the tertiary base element 52.

The tertiary base element 52 can also have a hole 62 for cooperating with tab 44 of the secondary base element 34 for more rigidly connecting elements 16, 34 and 52 together and forming a base assembly.

A cover element 64 has locking tabs 66, 66' (see FIGS. 4 and 5) matable with the inwardly directed edge portions 40, 40' of the secondary base element 34 for connecting the cover element 64 to the base assembly. The cover element is of channel configuration and of dimensions sufficient for nesting in the primary and secondary base element 16, 34 and maintaining the nuts 60 and/or 60' aligned with their respective boss opening 28, 28'.

The cover 64 is spaced from the bosses 26, 26' an amount sufficient for receiving a head of the threaded element 30, 30' between their boss and the cover 64. By this construction, the handle 14 can be front mounted with the head of the threaded members 30, 30' positioned within the handle, as shown by threaded member 30, or back mounted with the head of the threaded members 30, 30' positioned behind the front panel of the refrigerator door 12, as shown by threaded member 30'.

End caps 68, 70 can be provided for the first and second ends of the handle 14 to more rigidly maintain the handle together and to improve the appearance of the handle 14. The front end cap 68 extends over the ends of the primary base 16, the tertiary base 52, and the cover element 64, and the second end cap 70 extends over the ends of the secondary base 34 and the cover element 64. The end caps 68, 70 can have protrusions 72, 74 for mating with respective hole 62' and tab 46 for fixedly, releasably connecting the end caps 68, 70 to the handle 14.

In the assembled condition of the handle 14, the first and second end portions 18, 20 of the primary base 16 and the secondary base 34 lie in a plane. The middle portion 22 of the primary base 16 is spaced from the plane a distance sufficient for receiving an operator's fingers between said middle portion 22 and said plane.

Figure 6:
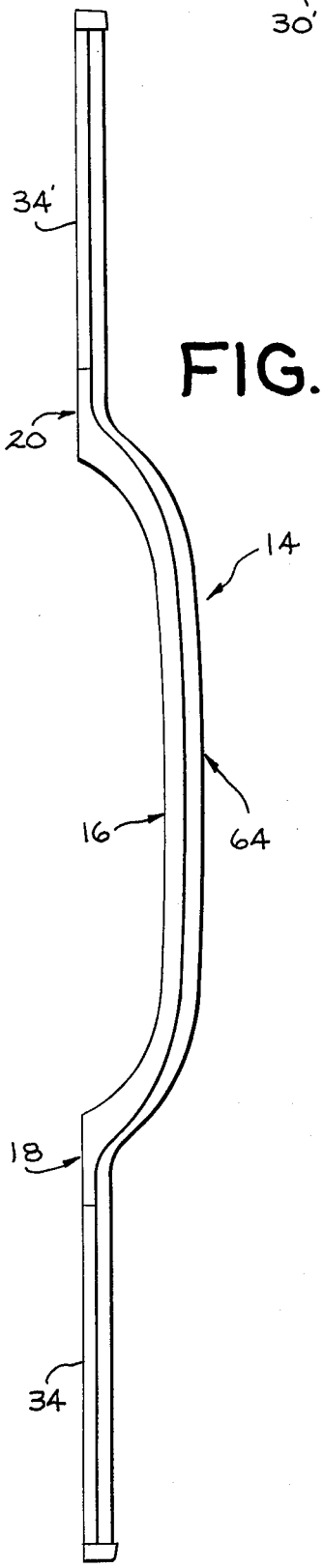
FIG. 6 is a diagrammatic view of another embodiment of the handle of this invention.

Referring to FIG. 6, an additional secondary base element 34' is connected to the second end portion 20 of the primary base 16 in the manner as set forth with regard to element 34. In this construction, the cover extends over said additional secondary base element 34'.

As can be seen from a study of the specification and the drawings, a plurality of handles of different appearance can be easily provided by changing the lengths and/or configuration of the secondary base element 34 and the cover element 64 and by using either one or two secondary base elements 34. The same construction of primary and secondary base elements 16, 34 is used with all of the different handle constructions.

Other modifications and alterations of this invention will become apparent to those skilled in the art from the foregoing discussion, and it should be understood that this invention is not to be unduly limited thereto.

We claim:

1. A door handle of a household refrigerator, comprising:

a first element having a first opening and a boss, said boss having an opening and an edge overlying a portion of the first opening;

a second element having inwardly extending edge portions and a protrustion of dimensions sufficient for insertion into the first opening for connecting the first and second elements;

a third element having a nut alignable with the boss opening and being of dimensions sufficient for extending over the second element protrusion and nesting in the first element; and a cover extending over said elements and having locking tabs matable with the second element edge portions for connecting the cover to the second element.

2. A door handle, as set forth in claim 1, including a nut and a boss positioned adjacent each end of the third element.

3. A door handle, as set forth in claim 1, wherein the cover is of dimensions sufficient for maintaining the nut aligned with the boss opening.

4. A door handle, as set forth in claim 1, wherein the cover is of dimensions sufficient for nesting in the first and second elements.

5. A door handle, as set forth in claim 1, wherein first and second end portions of the first element lie in a plane and the middle portion of the first element is spaced from the plane a distance sufficient for receiving an operator's fingers between said middle portion and said plane.

6. A door handle, as set forth in claim 1, including an additional second element connected to an opposed end of the first element and wherein the cover extends over said additional second element.

7. A door handle, as set forth in claim 1, wherein the cover is spaced from the boss an amount sufficient for receiving a head of a threaded element between said boss and said cover.

8. A door handle, as set forth in claim 1, including first and second end caps connected to respective first and second ends of the handle.

9. A door handle, as set forth in claim 8, wherein the first end cap extends over the ends of the first element, the third element, and the cover, and the second end cap extends over the ends of the second element and the cover.

10. A door handle, as set forth in claim 8, including protrusions on the end caps for releasably connecting the end caps to the handle.

* * * * *